United States Patent [19]

Honig

[11] 4,234,497

[45] Nov. 18, 1980

[54] ISO-PALMITATE POLYOL ESTER LUBRICANTS

[75] Inventor: Milton L. Honig, Bronx, N.Y.

[73] Assignee: Standard Lubricants, Inc., New York, N.Y.

[21] Appl. No.: 34,387

[22] Filed: Apr. 30, 1979

[51] Int. Cl.[3] ..... C09F 5/08; C10M 1/24

[52] U.S. Cl. ..... 260/410.6; 252/56 S

[58] Field of Search ..... 252/56 S; 268/410.6

[56] References Cited

U.S. PATENT DOCUMENTS

| | | | |
|---|---|---|---|
| 2,991,297 | 7/1961 | Cooley et al. | 260/410.6 |
| 3,309,318 | 3/1967 | Aylesworth et al. | 252/56 S |
| 3,332,983 | 7/1967 | Barie et al. | 260/410.6 |
| 3,414,609 | 12/1968 | Hagemeyer et al. | 260/410.6 |
| 3,694,382 | 9/1972 | Kleiman et al. | 260/410.6 X |
| 3,947,369 | 3/1976 | Leibfried | 252/56 S |
| 4,144,183 | 3/1979 | Koch et al. | 252/56 S |

*Primary Examiner*—John F. Niebling

*Attorney, Agent, or Firm*—Lackenbach, Lilling & Siegel

[57] ABSTRACT

A polyol ester, useful as a base stock in synthetic lubricants, comprising the reaction product of:

(a) one or more aliphatic polyhydric alcohols containing from 2 to 8 primary hydroxyl groups;

(b) a minor amount of iso-palmitic acid; and (c) one or more monocarboxylic acids having from 5 to 11 carbon atoms.

These esters exhibit unusually good low temperature, viscosity and seal swell properties. Engine oil additive compatibility is excellent.

10 Claims, No Drawings

ISO-PALMITATE POLYOL ESTER LUBRICANTS

BACKGROUND OF THE INVENTION

This invention is concerned with a synthetic functional fluid base stock and more particularly with certain polyol ester base stocks. Polyol esters are formed from the reaction of neopentyl type polyhydric alcohols and monocarboxylic acid compositions. These can be exemplified by trimethylol propane triheptanoate, a widely used commercial ester prepared from trimethylol propane and n-heptanoic acid. These esters are useful as base stock components in various types of lubricants and especially in crankcase oil formulations designed for gasoline, turbine and diesel engines.

Lubricants comprised of synthetic base stocks have a number of performance advantages over traditional lubricants containing naturally occurring mineral oil base stocks. Synthetic lubricants have demonstrated greater thermal stability, broader viscosity profiles, lower volatility and better frictional properties than mineral oils.

Automobile engines have become smaller to reduce vehicle weight and thereby save fuel. However, the thermal stress on the engine lubricant has increased concomitantly. The replacement of natural oils with more thermally stable synthetic base stocks, such as polyol esters can extend the lubricant's useful life significantly, e.g. from 7,000 miles to over 25,000 miles. Improved thermal-oxidative stability of the polyol ester contributes to the extended life of the lubricant.

A further advantage of synthetic lubricants, such as polyol esters, is that they have very broad viscosity profiles. As a result, lubricants can be formulated with synthetic base stocks that exhibit fluidity at much lower temperatures than presently possible with mineral oils and still provide adequate viscosity at hot operating temperatures. Improved cold weather starting and improved fuel economy result from good low temperature properties.

Synthetic base stocks also have improved frictional properties over mineral oils which is attributed to their chemical composition. Both the improved frictional properties and low temperatures fluidity are factors which contribute to improved fuel economy.

The lower volatility of synthetic lubricant base stocks also reduces the oil consumption rate.

While synthetic lubricant base stocks in general, and polyol esters in particular, have considerable performance advantages over mineral oil, there are problem areas. Generally, polyol esters and conventional engine oil additives are non-miscible with each other. Polyol esters also have deleterious effects on engine seals, excessive swelling being a big problem.

Seal "swell" is defined as the amount in percent that the volume of an elastomer engine seal expands upon contact with, and exposure to the lubricant environment under engine operating conditions. Insufficient or excessive swell causes the seals to lose their ability to retain and confine the engine fluids. Leakage occurs which can cause a high amount of oil consumption.

A controlled seal swell, sufficient to prevent lubricant leakage is therefore one of the most important properties of a crankcase lubricant.

The polyol esters of this invention are unique in that they overcome the additive miscibility and seal swelling problems normally associated with other polyol esters. Furthermore, it is desirable when formulating synthetic crankcase lubricants to use a polyol ester with both a high 210° F. viscosity and a low pour point. The high 210° F. viscosity will minimize the need for adding polymeric viscosity index improvers which thicken the formulation but also contribute to instability and engine deposits. Low pour point esters impart good low temperature fluidity to the lubricant composition. The polyol esters of this invention are unique in that they exhibit higher 210° F. viscosities and lower pour points than comparable esters without iso-palmitate.

British Patent Specification No. 1,444,826 discloses the usefulness of iso-palmitate polyol esters in hydraulic fluids. This patent confines itself to full iso-palmitate esters.

SUMMARY OF THE INVENTION

In the present invention, a synthetic lubricant base stock is comprised of certain polyol esters formed from the reaction product of:

(a) one or more aliphatic polyhydric alcohols containing from 2 to 8 primary hydroxyl groups;

(b) a minor amount of iso-palmitic acid; and (c) one or more monocarboxylic acids having from 5 to 11 carbon atoms.

DETAILED DESCRIPTION OF THE INVENTION

In accordance with the present invention, it has been found that the incorporation of minor amounts of iso-palmitic acid into a polyol ester composition formed from short chain monocarboxylic acids having 5 to 11 carbon atoms, significantly improves the ester properties. Rubber seal compatibility is another property that is significantly improved.

More specifically, the polyol ester composition comprises the reaction product of one or more aliphatic polyhydric alcohols containing from 2 to 8 primary hydroxyl groups, and one or more monocarboxylic acids having from 5 to 11 carbon atoms.

In general, the aliphatic polyhydric alcohols have the formula:

$$R(CH_2OH)_n,$$

wherein R is hydrocarbyl and n=2 to 8.

Preferred aliphatic polyhydric alcohols used as component (a) in producing the ester base stock of this invention can be neopentyl type polyhydric alcohols or polyols represented by the formula:

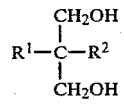

wherein $R^1$ and $R^2$ are each independently selected from the group consisting of $CH_3$, $CH_2CH_3$, $CH_2OH$ and $CH_2OCH_2C(CH_2OH)_3$. Examples of such neopentyl polyols include pentaerythritol, trimethylol propane, trimethylol ethane, dipentaerythritol, tripentaerythritol and neopentyl glycol. The polyols can be used singly or in combinations of 2 or more alcohols in the ester composition.

In general, the monocarboxylic acid, component (c) has the formula:

$$R^3CO_2H,$$

wherein $R^3$ is a $C_4$-$C_{10}$ hydrocarbyl.

While a variety of monocarboxylic acids can be useful as component (c) it is preferable to use acids such as valeric, n-hexanoic, n-heptanoic, n-octanoic, 2-ethyl hexanoic, n-nonanoic, n-decanoic and neo-decanoic acids. These acids can be used singly or in combinations of 2 or more acids in the ester composition.

The iso-palmitic acid has the formula:

$$CH_3(CH_2)_5\underset{\underset{COOH}{|}}{C}H(CH_2)_7CH_3.$$

It is preferred that the iso-palmitic acid concentration vary from about 5 to about 80 molar percent, more particularly, from about 20 to about 50 molar percent of the components (b)+(c).

It is preferred that the molar ratio of component (b), the iso-palmitic acid to component (c), the monocarboxylic acid range from about 0.05:1 to about 1:1, respectively. It is particularly preferred that the ratio of component (b) to component (c) range from 0.2:1 to about 0.5:1, by weight, respectively.

The polyol ester base stocks of the present invention can be prepared by procedures used for the preparation of esters generally. The components (a), (b) and (c) can be reacted by direct thermal fusion with or without a catalyst. However, use of a catalyst is preferred because reacting times can be significantly shortened and color formation more easily controlled. Catalysts such as inorganic acids, Lewis type acids, metallic oxides or the like are useful.

Preferred catalysts are the organo-tin and organo-titanium compounds having at least one organic group which can be an alkoxy, alkyl, dialkyl, aryloxy or alkylaryloxy group attached to the metal atom. Particularly preferred catalysts are stannous octoate and tetra-n-butyl titanate.

Water of reaction is removed from the reaction mixture. Generally, the monocarboxylic and iso-palmitic acids are reacted with the alcohol in proportions which provide a substantially completely esterified polyol ester.

Preferably, the polyol esters of this invention are prepared by reacting the alcohol component with the monocarboxylic acid component and iso-palmitic acid, in liquid phase, in the presence of a catalyst. Since the reaction proceeds very slowly at room temperature, elevated temperatures such as 100–300° C. are preferred to convert 99% of the acid to the ester within a few hours. The reaction generally takes 3 hours to 4.5 hours to complete depending upon the particular acids, alcohols, catalysts and catalyst concentrations used.

To facilitate the completion of the reaction, the water of esterification is removed as it forms. This can be done by carrying out the reaction in a liquid medium which forms an azeotropic mixture with water. The azeotropic mixture is continuously distilled to separate water from the ester.

Engine oil additive compatibility was significantly improved with esters incorporating small amounts of iso-palmitic acid. The additive-ester compatibility was determined by mixing 10 weight percent of a typical commerical engine oil additive package such as Amoco 6295 TM with 90 weight percent of the ester base stock under conditions of agitation and 100° F. heat; homogeneity and clarity were visually measured.

Amoco 6295 TM is a widely used proprietary engine oil additive package. It contains a corrosion inhibitor, anti-wear agent, detergent, dispersant, antioxidant and mineral oil carrier fluid. Calcium and magnesium alkylaryl sulfonates are the chemical components that impart detergency properties. Alkyl succinates and alkylated phenols are used to impart dispersancy and antioxidant properties, respectively. Zinc dialkyl dithiophosphates and benzotriazole impart anti-wear and copper corrosion protection, respectively. There are a number of similar engine oil additive packages, such as Lubrizol 4850 TM, Chevron OLOA 2852 TM and Exxon 7437A TM.

In the examples that follow, all parts and percentages are by weight, unless otherwise noted.

EXAMPLE 1

A trimethylol propane ester of iso-palmitic acid and 2-ethyl hexanoic acid was synthesized using the following reagents according to the following reaction scheme:

| REAGENTS | MOL. WT. | MOLES | GRAMS |
|---|---|---|---|
| Trimethylol propane (TMP) | 134 | 1.0 | 134 |
| 2-Ethyl hexanoic Acid (Et Hex) | 144 | 2.65* | 381 |
| Iso-palmitic Acid | 256 | 0.5 | 128 |
| Heptane | | | 100 |
| Stannous Octoate | | | 1 |

*Added in 5% excess.

$$\text{TMP} + 0.5\ \text{i-}C_{16} + 2.5\ \text{Et Hex} \xrightarrow[\text{Heptane, stannous octoate}]{140\text{–}250^\circ\ \text{C.}} \text{TMP/0.5 i-}C_{16}\text{/2.5 Et Hex ester} + 3\ H_2O$$

Trimethylol propane, iso-palmitic acid, 2-ethyl hexanoic acid, heptane and the stannous octoate were placed into a 2-liter 3-neck round bottom reaction flask fitted with a Dean Stark water trap. The charge was agitated with a motor driven glass stirring rod and heated at reflux for 26 hours. Heptane was removed, in 10 ml amounts, periodically, to increase the temperature of the reaction mixture. An additional 1 gram of stannous octoate catalyst was added at both 8 and 22.5 hours. When 53.5 ml of water (54 ml theoretical) had been collected, the remaining volatiles were removed by raising the pot temperature to 250° C. (atmospheric pressure).

The reaction mixture was vacuum stripped at 260° C./3.6 mm Hg using a vacuum distillation head. The product was cooled to 90° C. Five grams of calcium oxide and 25 ml of water were added and the pot contents stirred at 90° C. for 1.5 hours. About 50 cc of Celite filter-aid was added and stirred for an additional 5 minutes. The mixture was then vacuum filtered through a Buchner funnel to separate solids. Subsequently, the crude product was vacuum stripped at 140° C. and 1 mm Hg. Upon cooling to 90° C., 10 cc of basic alumina and 20 cc of decolorizing charcoal were added and stirred for 30 minutes at 90° C. While still hot, the product was vacuum filtered through a sintered glass funnel. This gave 492.5 grams of a light yellow liquid product (87% yield). The final acid number was 0.03 mg KOH/gm sample. Other physical properties are listed in Table 2.

EXAMPLE 2

A trimethylol propane-dipentaerythritol ester of n-heptanoic, 2-ethyl hexanoic and iso-palmitic acids was synthesized using the following reagents according to the following reaction scheme:

| REAGENTS | MOL. WT. | MOLES | GRAMS |
|---|---|---|---|
| Trimethylol propane (TMP) | 134 | 0.66 | 88.4 |
| Dipentaerythritol (DiPE) | 254 | 0.33 | 83.8 |
| n-Heptanoic Acid ($C_7$) | 130 | 1.5 | 195 |
| 2-Ethyl hexanoic Acid (Et Hex) | 144 | 2.15* | 310 |
| Iso-palmitic Acid (i-$C_{16}$) | 256 | 0.5 | 128 |
| Xylene | | | 100 |
| Tetra-n-butyl Titanate (TNBT) | | | 2 |

*Added in 5% excess 0.66 TMP + 0.33 DiPE + 1.5 $C_7$ + 0.5i-$C_{16}$ + 2 Et Hex $$\xrightarrow[\text{Xylene, TNBT}]{198\text{–}246^\circ\text{ C.}} 0.66\text{ TMP}/0.33\text{ DiPE}/1.5C_7/0.5iC_{16}/2\text{ Et Hex ester} + 4\ H_2O$$

A 2-liter 3-neck round bottom flask was fitted with the esterification equipment outlined in Example 1.

Trimethylol propane, dipentaerythritol, n-heptanoic acid, 2-ethyl hexanoic acid, xylene and tetra-n-butyl titanate were placed into the reaction flask. The charge was stirred and heated at reflux for 11 hours. Xylene was removed, in 10 ml amounts, periodically, to increase the temperature of the reaction mixture. An additional 1 gram of TNBT catalyst was added after 7 hours. After 71.0 ml of water (71.3 ml theroretical) had been collected, the Dean-Stark trap and condenser were replaced by a distillation head. The remaining volatiles were then removed by slowly raising the pot temperature to 265° C. and slowly decreasing the pressure to 2 mm Hg.

Upon cooling to 90° C., 6 grams of calcium oxide and 25 ml of water were added to the crude ester product. This mixture was stirred for 1 hour at 90° C. About 50 cc of Celite filter-aid was then added and stirred for an additional 5 minutes. Solids were separated from the ester by filtration through a Buchner funnel.

Thereafter, the product was vacuum stripped by slowly increasing the temperature to 150° C. and decreasing the vacuum to 1.4 mm Hg. Upon cooling down to 90° C., 10 cc of basic alumina and 30 cc of decolorizing charcoal were added and stirred for 30 minutes at 90° C. While still hot, the product was vacuum filtered through a sintered glass funnel. This gave 584.7 grams of an amber colored liquid product (80% yield). Physical properties are outlined in Table 2.

EXAMPLES 3–10

These examples were carried out in a procedure similar to Example 1. Stannous octoate and heptane were used as the catalyst and azeotrope solvent, respectively. Table 1 below lists the reaction times and yields. These values are not optimized reaction conditions.

TABLE 1

| Example | Reaction Time (Hrs) | Yield (%) |
|---|---|---|
| 3 | 40 | 77 |
| 3b | 17 | 92 |
| 4 | 21 | 89 |
| 4a | 15 | 88 |
| 5 | 19 | 84 |
| 6 | 34 | 88 |
| 6a | 56 | 84 |
| 7 | 21 | 83 |
| 8 | 19 | 84 |
| 9 | 14 | 86 |
| 9a | 9 | 81 |
| 10 | 45 | 76 |

TABLE 2

Composition of the Iso-palmitate Polyol Esters and the "Unimproved" Control Polyol Esters

| Iso-palmitate Containing Esters | | "Unimproved" Control Esters | |
|---|---|---|---|
| Example | Ester Composition | Example | Ester Composition |
| 1 | TMP/0.5 i-$C_{16}$/2.5 Et Hex | 1a | TMP/3 Et Hex |
| 2 | 0.66 TMP/0.33 DiPE/1.5 $C_7$/0.5 i-$C_{16}$/2 Et Hex | 2a | 0.66 TMP/0.33 DiPE/2 $C_7$/2 Et Hex |
| 3 | TMP/0.5 i-$C_{16}$/2.5 $C_7$ | 3a | TMP/3 $C_7$ |
| | | 3b | TMP/0.5 n-$C_{16}$/2.5 $C_7$ |
| 4 | TMP/0.25 i-$C_{16}$/2.75 $C_9$ | 4a | TMP/3 $C_9$ |
| 5 | TMP/0.5 i-$C_{16}$/2.5 $C_9$ | 4a | TMP/3 $C_9$ |
| 6 | PE/1 i-$C_{16}$/3 Et Hex | 6a | PE/4 Et Hex |
| 7 | PE/0.5 i-$C_{16}$/3.5 $C_7$ | 7a | PE/4 $C_7$ |
| 8 | PE/1 i-$C_{16}$/3 $C_7$ | 7a | PE/4 $C_7$ |
| 9 | PE/0.5 i-$C_{16}$/3.5 $C_9$ | 9a | PE/4 $C_9$ |
| 10 | PE/2 i-$C_{16}$/2 $C_9$ | 9a | PE/4 $C_9$ |

KEY:
TMP = Trimethylol propane
DiPE = Dipentaerythritol
PE = Pentaerythritol
i-$C_{16}$ = Iso-palmitic Acid
n-$C_{16}$ = n-Palmitic Acid
Et Hex = 2-Ethyl Hexanoic Acid
$C_7$ = n-Heptanoic Acid
$C_9$ = Pelargonic Acid

TABLE 3

Physical Property Comparison Between Iso-palmitate Polyol Esters and "Unimproved" Control Polyol Esters

| Iso-palmitate Containing Esters | | | | | | "Unimproved" Control Esters | | | | | |
|---|---|---|---|---|---|---|---|---|---|---|---|
| Example | Viscosity 210° F. | (cSt) 100° F. | Pour Point °F. | Rubber Swell (%) Buna N | Rubber Swell (%) Polyacrylate | Example | Viscosity 210° F. | (cSt) 100° F. | Pour Point °F. | Rubber Swell (%) Buna N | Rubber Swell (%) Polyacrylate |
| 1 | 5.00 | 35.3 | −60 | 6.3 | 26.4 | 1a | 4.43 | 2.73 | −60 | 12.9 | 48.3 |
| 2 | 7.35 | 50.0 | −45 | 6.1 | 22.2 | 2a | 6.10 | 4.67 | −50 | 11.3 | 37.6 |
| 3 | 4.84 | 20.9 | −70 | 14.2 | 38.4 | 3a | 3.50 | 15.2 | −75 | 28.4 | 65.5 |
| | | | | | | 3b | 4.73 | 21.7 | −5 | 14.0 | 32.4 |
| 4 | 5.12 | 28.0 | −55 | 8.8 | 22.7 | 4a | 5.11 | 21.3 | −55 | 10.9 | 27.1 |
| 5 | 5.21 | 27.4 | −55 | 7.6 | 20.5 | 4a | 5.11 | | | | |
| 6 | 7.48 | 58.8 | −50 | 1.8 | 16.2 | 6a | 6.31 | 50.2 | +25 | 7.55 | 38.4 |
| 7 | 5.46 | 29.0 | −60 | 10.2 | 33.1 | 7a | 5.75 | 31.8 | −40 | 23.2 | 60.4 |

TABLE 3-continued

| Physical Property Comparison Between Iso-palmitate Polyol Esters and "Unimproved" Control Polyol Esters | | | | | | | | | | | |
|---|---|---|---|---|---|---|---|---|---|---|---|
| Iso-palmitate Containing Esters | | | | | | "Unimproved" Control Esters | | | | | |
| Example | Viscosity 210° F. | (cSt) 100° F. | Pour Point °F. | Rubber Swell (%) Buna N | Rubber Swell (%) Polyacrylate | Example | Viscosity 210° F. | (cSt) 100° F. | Pour Point °F. | Rubber Swell (%) Buna N | Rubber Swell (%) Polyacrylate |
| 8 | 6.15 | 39.5 | −35 | 5.3 | 19.1 | 7a | 5.75 | | | | |
| 9 | 7.24 | 41.6 | −5 | 3.4 | 13.6 | 9a | 6.30 | 33.7 | +35 | 5.3 | 18.0 |
| 10 | 8.47 | 56.7 | −35 | −1.2 | 4.5 | 9a | 6.30 | | | | |

The examples readily demonstrate the improved properties obtained by using the inventive composition. More specifically, these include improved pour points, higher viscosity, improved seal swell and additive compatibility.

Rubber seal compatibility is a property that is significantly improved when small amounts of iso-palmitic acid are incorporated into the ester. In Example 1*a*, a polyol ester formed from the complete esterification of 1 mole of trimethylol propane with 3 moles of 2-ethyl hexanoic acid provides an ester having a Buna N and polyacrylate rubber swell of 12.9% and 48.3%, respectively. By replacing only 0.5 moles of the 3 moles of 2-ethyl hexanoic acid with iso-palmitic acid in the reaction composition, an ester (Example 1) is obtained having a Buna N and polyacrylate rubber swell of 6.3% and 26.4%, respectively.

The polyol ester of Example 3*a* is formed from the complete esterification of 1 mole of trimethylol propane with 3 moles of n-heptanoic acid and provides an ester having a Buna N and polyacrylate rubber swell of 28.4% and 65.5%, respectively. By replacing only 0.5% moles of the 3 moles of n-heptanoic acid with iso-palmitic acid in the reaction composition, an ester (Example 3) is obtained having a Buna N and polyacrylate rubber swell of 14.2% and 38.4%, respectively.

In Example 7*a*, the polyol ester formed from the complete esterification of 1 mole of pentaerythritol with 4 moles of n-heptanoic acid provides an ester having a Buna N and polyacrylate rubber swell of 23.2% and 60.4%, respectively. By replacing 1 mole of the 4 moles of n-heptanoic acid with iso-palmitic acid in the reaction composition, an ester (Example 8) is obtained having a Buna N and polyacrylate rubber swell of 5.3% and 19.1%, respectively.

The polyol ester of Example 2*a*, formed from the complete esterification of 0.66 moles trimethylol propane and 0.33 moles dipentaerythritol with 2 moles n-heptanoic acid and 2 moles 2-ethyl hexanoic acid was found to be incompatible with the additive package Amoco 6295 TM and exhibited severe haze. By replacing only 0.5 moles of the 2 moles of n-heptanoic acid with iso-palmitic acid, an ester (Example 2) was obtained that was compatible with the additive package and remained crystal clear even at a low temperature of 10° F. for extended periods of time (3 days).

Iso-palmitic acid's unique efficacy is perhaps best contrasted with that of its isomer, n-palmitic acid. Example 3*b* describes a polyol ester formed from the complete esterification of 1 mole of trimethylol propane with 2.5 moles n-heptanoic acid and 0.5 moles of n-palmitic acid. This ester exhibits a poor pour point of −5° F. In contrast, the ester of Example 3 which contains 0.5 moles iso-palmitic acid in lieu of the n-palmitic acid, exhibits an excellent pour point of −70° F. Rubber swell and viscosity values of Examples 3 and 3*b* are similar.

In Example 6*a*, a polyol ester formed from the complete esterification of 1 mole pentaerythritol with 4 moles of 2-ethyl hexanoic acid provides an ester having a 25° F. pour point and a 6.3 centistoke viscosity (at 210° F.). By replacing only 1 of the 4 moles of 2-ethyl hexanoic acid with iso-palmitic acid in this composition, an ester (Example 6) is obtained having a −50° F. pour point and a 7.5 centistoke viscosity (at 210° F.).

In Example 9*a*, a polyol ester formed from the complete esterification of 1 mole of pentaerythritol with 4 moles of nonanoic (also called pelargonic) acid provides a fluid having a +35° F. pour point and a 6.3 centistoke viscosity (at 210° F.). By replacing only 0.5 of the 4 moles of nonanoic acid with isopalmitic acid in this reaction composition, an ester fluid (Example 9) is obtained having a −5° F. pour point and a 7.2 centistoke viscosity (at 210° F.). By replacing 2 of the 4 moles of nonanoic acid with iso-palmitic acid in this composition, the resultant ester (Example 10) pour point is lowered to −35° F. and the 210° F. viscosity is increased to 8.5 centistokes.

What is claimed is:

1. An iso-palmitate polyol ester lubricant base stock, comprising the reaction product of:

(a) one or more aliphatic polyhydric alcohols containing from 2 to 8 primary hydroxyl groups;

(b) a minor amount of iso-palmitic acid;

$$CH_3(CH_2)_5\underset{\underset{COOH}{|}}{C}H(CH_2)_7CH_3;\text{ and}$$

(c) one or more monocarboxylic acids, having the formula:

$$R^3CO_2H,$$

wherein $R^3$ is $C_4$–$C_6$ hydrocarbyl or $CH_3(CH_2)_3CH(C_2H_5)$;

and wherein the iso-palmitic acid concentration varies from about 5 to about 20 molar percent of the components (b)+(c).

2. The ester of claim 1, wherein component (a) is a neopentyl polyhydric alcohol represented by the formula:

$$R^1-\overset{\overset{CH_2OH}{|}}{\underset{\underset{CH_2OH}{|}}{C}}-R^2\text{, and}$$

wherein $R^1$ and $R^2$ are each independently selected from the group consisting of $CH_3$, $C_2H_5$, $CH_2OH$ and $CH_2OCH_2C(CH_2OH)_3$.

3. The ester of claim 2, wherein the neopentyl polyhydric alcohol (a) is selected from the group consisting of trimethylol propane, pentaerythritol, and dipentaerythritol.

4. The ester of claim 1, where the monocarboxylic acid (c) is selected from the group consisting of heptanoic acid, valeric acid, and 2-ethyl hexanoic acid.

5. The ester of claim 2, wherein the neopentyl polyhydric alcohol is substantially completely esterified.

6. A method for preparing an iso-palmitate polyol ester lubricant base stock comprising, reacting (a) one or more aliphatic polyhydric alcohols containing from 2 to 8 primary hydroxyl groups;

(b) a minor amount of iso-palmitic acid;

$$CH_3(CH_2)_5\underset{\underset{COOH}{|}}{C}H(CH_2)_7CH_3;\text{ and}$$

(c) one or more monocarboxylic acids, having the formula:

$$R^3CO_2H,$$

wherein $R^3$ is $C_4$–$C_6$ hydrocarbyl or $CH_3(CH_2)_3CH(C_2H_5)$; and wherein the iso-palmitic acid concentration varies from about 5 to about 20 molar percent of the components (b)+(c); in liquid phase, in the presence of a catalyst selected from the group consisting of organo tin and organo titanium compounds having at least one organic group attached to the metal atom, selected from the group consisting of alkoxy, alkyl, dialkyl, amino aryloxy, and alkylaryloxy; at a temperature varying from 100°–300° C. under azeotropic conditions, and vacuum stripping the product.

7. The method of claim 6, wherein the catalyst is selected from the group consisting of tetra-n-butyl titanate and stannous octoate.

8. The ester of claim 4, wherein the monocarboxylic acid (c) is 2-ethyl hexanoic acid.

9. The method of claim 6, wherein the monocarboxylic acid (c) is selected from the group consisting of heptanoic acid, valeric acid, and 2-ethyl hexanoic acid.

10. The method of claim 9, wherein the monocarboxylic acid is 2-ethyl heptanoic acid.

* * * * *